US009975259B2

(12) United States Patent
Liu

(10) Patent No.: US 9,975,259 B2
(45) Date of Patent: May 22, 2018

(54) FOLDING KNIFE

(75) Inventor: Guanpeng Liu, Guangdong (CN)

(73) Assignees: Power Source Industries Co. Ltd., Yangjiang (CN); Nextorch Industries Co., Ltd., Yangjiang (CN); Wave Power Source Police Equipments Co., Ltd, Yangjiang (CN)

( * ) Notice: Subject to any disclaimer, the term of this patent is extended or adjusted under 35 U.S.C. 154(b) by 382 days.

(21) Appl. No.: 13/522,373

(22) PCT Filed: May 15, 2012

(86) PCT No.: PCT/CN2012/075515
§ 371 (c)(1),
(2), (4) Date: Jul. 16, 2012

(87) PCT Pub. No.: WO2013/091340
PCT Pub. Date: Jun. 27, 2013

(65) Prior Publication Data

US 2013/0160300 A1 Jun. 27, 2013

(30) Foreign Application Priority Data

Dec. 22, 2011 (CN) ..... 2011 1 0437211

(51) Int. Cl.
*B26B 1/04* (2006.01)
*B26B 1/02* (2006.01)
*B26B 1/06* (2006.01)

(52) U.S. Cl.
CPC ..... *B26B 1/048* (2013.01)

(58) Field of Classification Search
CPC ..... B26B 1/04; B26B 1/046; B26B 1/044; B26B 1/048; B26B 1/00; B26B 1/06; B26B 1/02
(Continued)

(56) References Cited

U.S. PATENT DOCUMENTS 5,495,674 A * 3/1996 Taylor, Jr. ..... 30/160
6,122,829 A * 9/2000 McHenry et al. ..... 30/161
(Continued)

FOREIGN PATENT DOCUMENTS

CN 101653946 A 2/2010

OTHER PUBLICATIONS

Abstract of CN101653946 (A) in English.

*Primary Examiner* — Sean Michalski
*Assistant Examiner* — Fernando Ayala
(74) *Attorney, Agent, or Firm* — Porter, Wright, Morris & Arthur, LLP

(57) ABSTRACT

The invention discloses a folding knife, comprising: a blade, whose upper part is configured with a lockup switch mounting hole; a handle, whose lower part is configured with a stopping slot; a lockup switch provided in the lockup switch mounting hole and having a lockup part located on the first side of the blade, the lockup part has a lockup position at which it is clapped in the stopping slot when the blade and the handle are buckled up and an unlock position at which it is released from the stopping slot when the blade is separated from the handle. The folding knife of the invention enables safe locking after the blade is folded in the handle by making use of the lockup switch having a lockup part, the structure of the folding knife is simple and easy to implement, and safety performance of the folding knife is improved.

11 Claims, 6 Drawing Sheets

(58) Field of Classification Search
USPC ..... 30/153, 155, 158, 160, 161, 164, 255, 30/308.2
See application file for complete search history.

(56) References Cited

U.S. PATENT DOCUMENTS

| | | | | |
|---|---|---|---|---|
| 6,154,965 | A * | 12/2000 | Sakai | B26B 1/048 30/160 |
| 6,276,063 | B1 * | 8/2001 | Chen | 30/161 |
| 6,378,214 | B1 * | 4/2002 | Onion | 30/161 |
| 7,506,446 | B2 * | 3/2009 | Onion | B26B 1/048 30/160 |
| 7,581,321 | B2 * | 9/2009 | Kain | 30/153 |
| 7,774,939 | B1 * | 8/2010 | Onion | 30/161 |
| 2001/0039735 | A1 * | 11/2001 | Neveux | 30/161 |
| 2002/0029481 | A1 * | 3/2002 | Eickhorn | 30/161 |
| 2004/0020057 | A1 * | 2/2004 | Hughes | 30/155 |
| 2005/0120564 | A1 * | 6/2005 | Chen Lin | 30/169 |
| 2006/0174490 | A1 * | 8/2006 | Galyean et al. | 30/153 |
| 2010/0212163 | A1 * | 8/2010 | Liu | 30/159 |

* cited by examiner

FOLDING KNIFE

FIELD OF THE INVENTION

The invention relates to the field of hardware knife, and in particular to a folding knife.

BACKGROUND OF THE INVENTION

The existing folding knife usually lacks of a safety locking structure or the safety lock is inconvenient for operation.

On the other hand, the folding knife has a leaf spring boosting anti-rebound structure which is comparatively complicated, not easy to implement, which will increase the cost of the folding knife.

SUMMARY OF THE INVENTION

The purpose of the present invention is to provide a folding knife, which can solve the problems that the existing folding knife lacks of a safety locking structure or the safety lock is inconvenient for operation.

For achieving the above purpose, the invention discloses a folding knife, comprising: a blade, whose upper part is configured with a lockup switch mounting hole; a handle, whose lower part is configured with a stopping slot; a lockup switch provided in the lockup switch mounting hole and having a lockup part located on the first side of the blade, the lockup part has a lockup position at which the lockup part is clapped in the stopping slot when the blade and the handle are buckled up and an unlock position at which it is released from the stopping slot when the blade is separated from the handle.

Further, the lockup switch mounting hole is a long kidney-shaped hole parallel with an extending direction of the blade; the lockup switch further comprises: a spring provided in the long kidney-shaped hole and in an extending direction of the long kidney-shaped hole; a stopper located between one end of the spring close to a tip of the blade and an inner wall of one corresponding end of the long kidney-shaped hole, with the lockup part connected with the stopper.

Further, the lockup switch further comprises a dial button located on the second side of the blade and connected with the stopper.

Further, an outer surface of the dial button is configured with anti-skid corrugations.

Further, one end of the stopper connected with the spring is configured with a groove, and one end of the spring close to the blade is located in the groove.

Further, the stopper further comprises a cylinder-shaped mounting hole, and the lockup part is connected with the stopper through a cylinder-shaped splicing part in interference fit with the cylinder-shaped mounting hole.

Further, the lockup switch further comprises a locking block matching with the lockup switch mounting hole in shape, and the lockup part and the cylinder-shaped splicing part are located on two sides of the locking block respectively.

Further, an inner wall of the lockup switch mounting hole is formed with two stepped surfaces, the spring and the stopper are corresponding with the first stepped surface, and the locking block is corresponded with the second stepped surface.

Further, the folding knife of the invention further comprises a leaf spring, with the leaf spring and the handle being integrated.

Further, the first end of the leaf spring is connected with a tail end of the handle, the second end of the leaf spring is a free end, and the front end of the handle is further configured with a pin in cooperation with the leaf spring.

The invention has the following beneficial effects:

The folding knife of the invention enables the safe locking after the blade is folded into the handle by making use of the lockup switch having a lockup part, the folding knife is in the simple structure and easy to implement, and safety performance of the folding knife is improved.

Besides the purposes, features and advantages described above, the present invention also has other purposes, features and advantages. The invention will be further explained in detail with reference to drawings in the following parts.

BRIEF DESCRIPTION OF THE DRAWINGS

Drawings, which form a part of the description and are provided for further understanding of the present invention, show the preferred embodiments of the present invention, and explain the principle of the present invention together with the description. In the drawings.

DETAILED DESCRIPTION OF THE EMBODIMENTS

The embodiments of the present invention will be described in detail below with reference to drawings, however, the present invention may be implemented by various different ways defined and covered by the claims.

Figure 1:
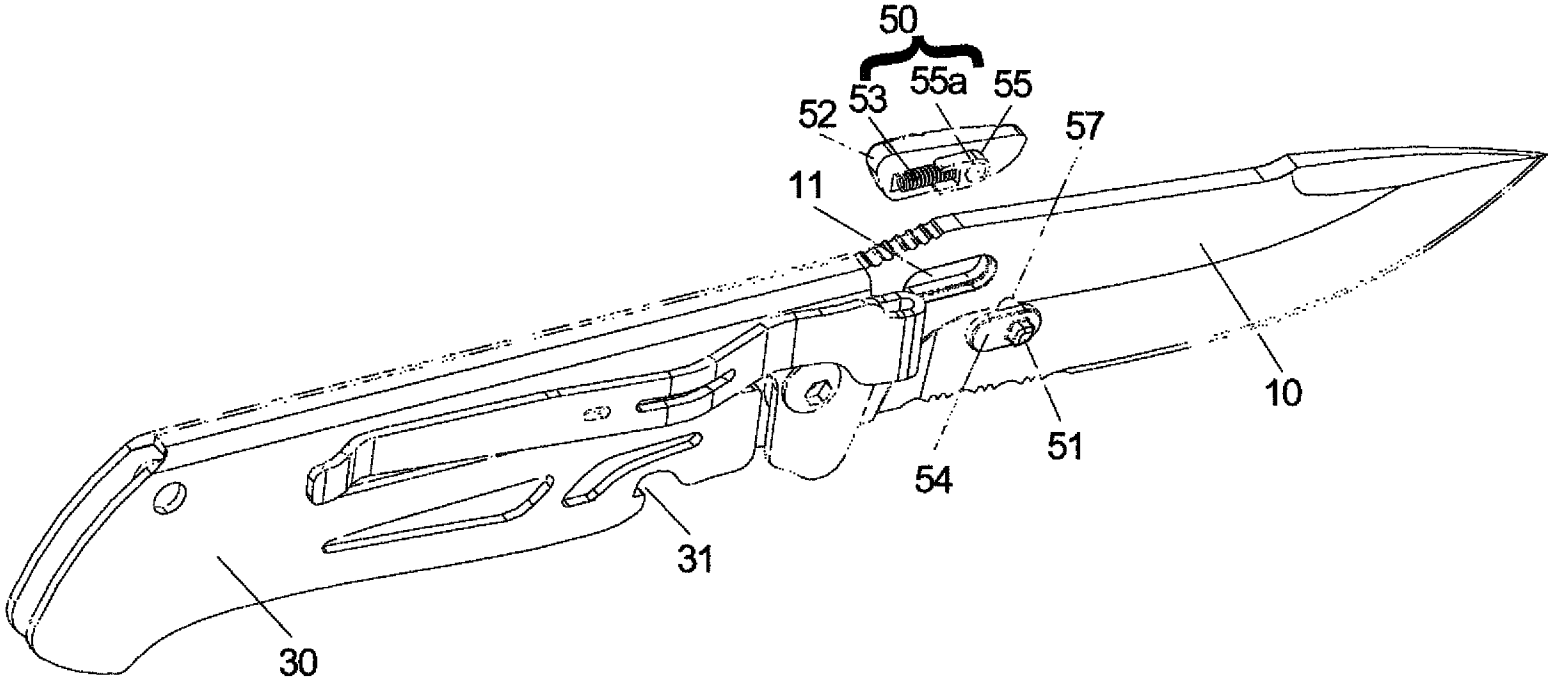
FIG. 1 schematically shows the structure of the folding knife in an open status according to one preferred embodiment of the disclosure.
Figure 2:
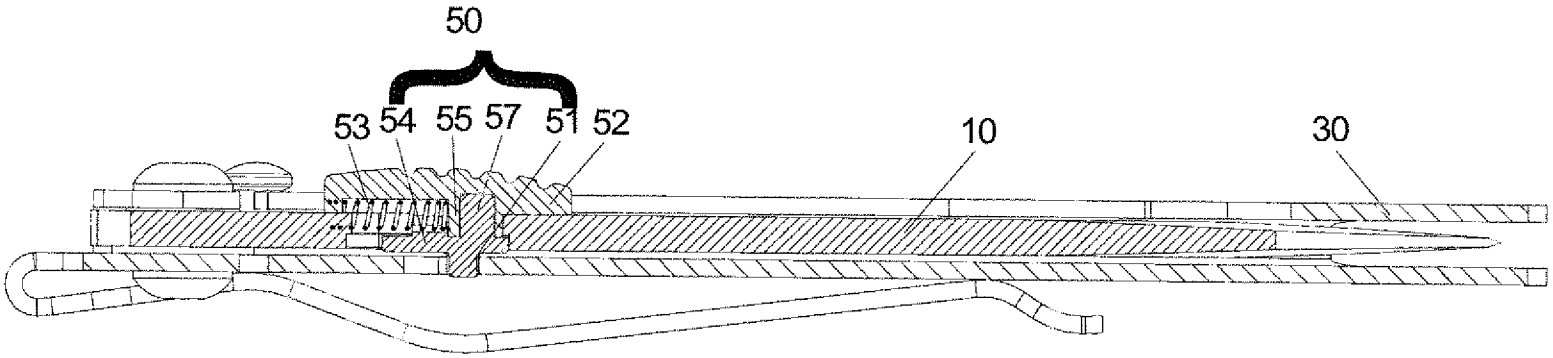
FIG. 2 schematically shows in the cross-sectional view the top of the folding knife according to one preferred embodiment of the disclosure.

As shown in FIG. 1 and FIG. 2, the folding knife of the invention comprises: a blade 10, whose upper part is configured with a lockup switch mounting hole 11; a handle 30, whose lower part is configured with a stopping slot 31; a lockup switch 50 provided in the lockup switch mounting hole 11 and having a lockup part 51 located on the first side of the blade 10, the lockup part 51 has a lockup position at which the lockup part is clapped in the stopping slot 31 when the blade 10 and the handle 30 are buckled up and an unlock position at which the lockup part is released from the stopping slot 31 when the blade 10 are separated from the handle 30.

With the folding knife of the present invention, the blade 10 and handle 30 are simply modified, such that the locking of the folding knife in the folding status is achieved by making use of the lockup switch 50 mounted on the blade 10, with the structure being simple and the implementation being easy, and the additional cost being low.

Specifically, the lockup switch mounting hole 11 is a long kidney-shaped hole parallel with an extending direction of the blade 10; the lockup switch 50 further comprises a spring 53 and a stopper 55, wherein the spring 53 is provided in the long kidney-shaped hole and the spring 53 is provided in an extending direction of the long kidney-shaped hole; the stopper 55 is located between one end of the spring 53 close to a tip of the blade 10 and an inner wall of one corresponding end of the long kidney-shaped hole, and the lockup part 51 is connected with the stopper 55.

Figure 3:
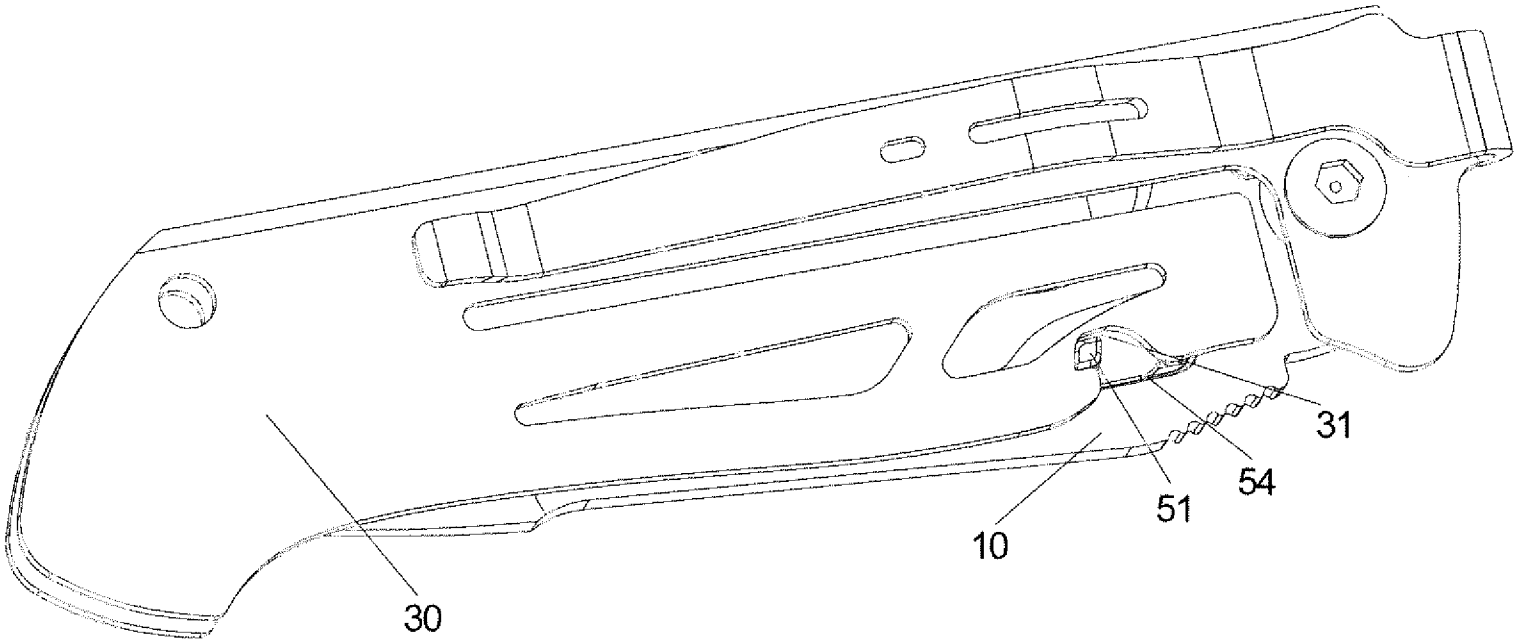
FIG. 3 schematically shows the structure of the lockup part of the folding knife in locking position according to one preferred embodiment of the disclosure.

As shown in FIG. 3, when the blade 10 is folded in a knife slot of the handle 30, the stopper 55 is located at one end of the long kidney-shaped hole close to the tip under the action of elastic force of the spring 53. When the blade 10 is folded in the knife slot of the handle 30, the lockup part 51 is in a lockup position (the position of the lockup part 51 shown in FIG. 3).

Figure 4:
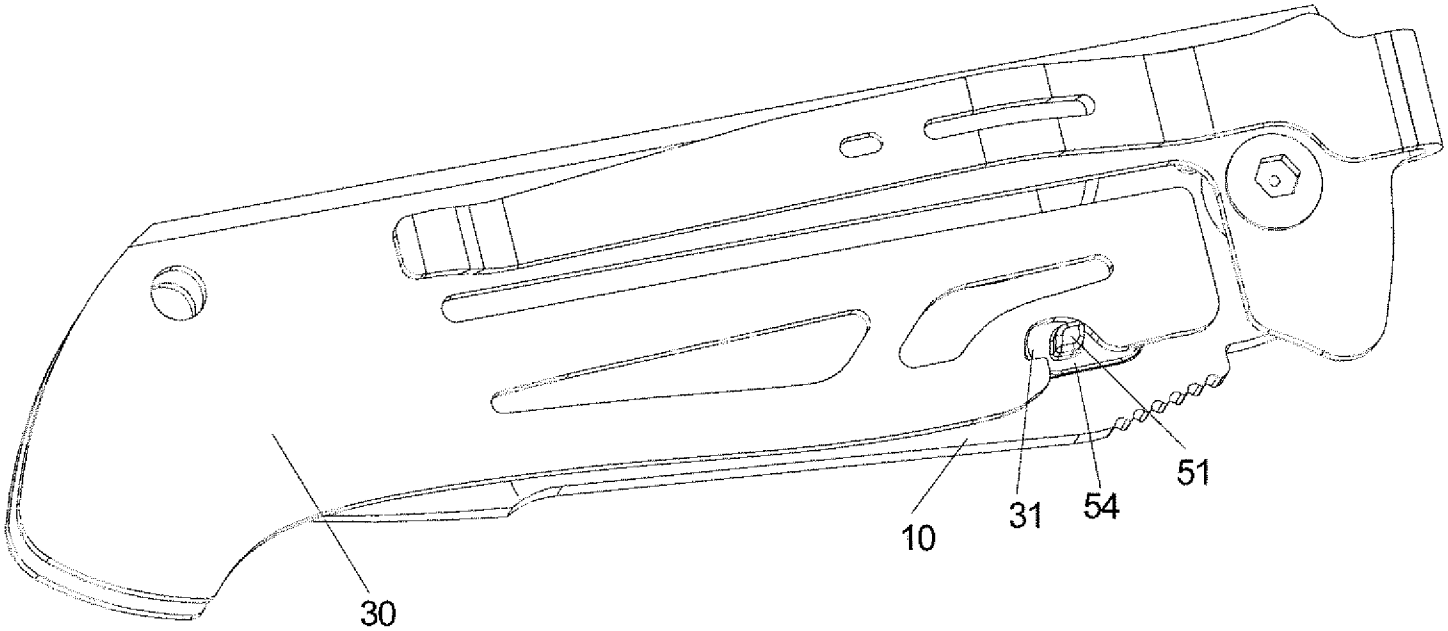
FIG. 4 schematically shows the structure of the lockup part of the folding knife in unlocking position according to one preferred embodiment of the disclosure.

As shown in FIG. 4, when unfolding the blade 10 from the knife slot of the handle 30, it is needed to adjust the lockup part 51 from the lockup position to the unlock position (the position of the lockup part 51 shown in FIG. 4). For implementing this movement, the lockup switch 50 further comprises a dial button 52 for dialing the lockup part 51, and the dial button 52 is located on the second side of the blade 10 and connected with the stopper 55. The dial button 52 dials the stopper 55 to move toward the root of the blade 10 to compress the spring 53. As the lockup part 51 is connected with the stopper 55, in the case of being driven by the stopper 55, the lockup part 51 is released from the stopping slot 31, to be in the unlock position, the blade 10 is ejected from the knife slot of the handle 30, making the folding knife open.

Figure 5:
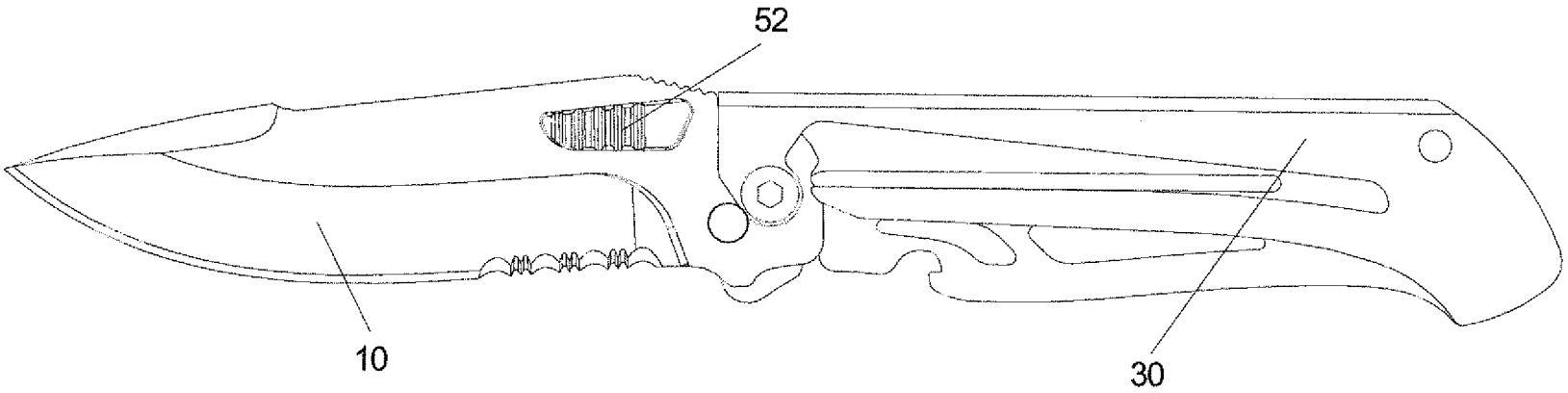
FIG. 5 schematically shows the structure of the outer surface of the dial button of the folding knife according to one preferred embodiment of the disclosure.

As shown in FIG. 5, for improving convenience of operation, the outer surface of the dial button 52 is configured with anti-skid corrugations.

In fact, the stopper 55 and the dial button 52 can be integrated to one-piece (As shown in FIG. 2).

For making the stopper 55 reliably move under the action of the spring 53, one end of the stopper 55 connected with the spring 53 is configured with a groove, and one end of the spring 53 close to the blade 10 is located in the groove. By using the groove, it can prevent the spring 53 from being released from the stopper 55.

For implementing connection between the stopper 55 and the lockup part 51, the stopper 55 further comprises a cylinder-shaped mounting hole 55*a* (as shown in FIG. 1), which is located on the end of the stopper 55 opposite to the groove, and the lockup part 51 is connected with the stopper 55 through a cylinder-shaped splicing part 57 in interference fit with the cylinder-shaped mounting hole 55*a*.

For the purpose of enclosure and aesthetics, the lockup switch 50 further comprises a locking block 54 (as shown in FIG. 1 and FIG. 2) matching with the lockup switch mounting hole 11 in shape, and the lockup part 51 and the cylinder-shaped splicing part 57 are located on two sides of the locking block 54 respectively.

An inner wall of the lockup switch mounting hole 11 is formed with two stepped surfaces. The spring 53 and the stopper 55 are corresponding with the first stepped surface, and the locking block 54 is corresponding with the second stepped surface. By use of the stepped surfaces, there would be two functions, the first of which is to prevent rotation of the locking block 54 but allow slide, and the second of which is to prevent each part of the lockup switch 50 from moving to the second side of the blade 10 to be released.

Figure 6:
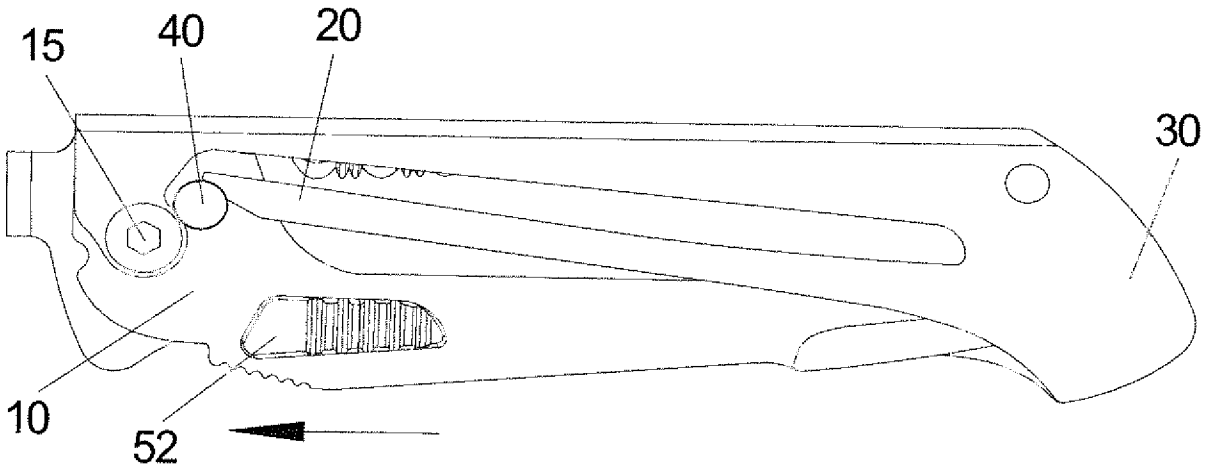
FIG. 6 schematically structurally shows the positions of the leaf spring and the pin of the folding knife according to one preferred embodiment of the disclosure.

As shown in FIG. 6, the folding knife of the invention further comprises a leaf spring 20, and the leaf spring 20 and the handle are integrated. The handle 30 and the leaf spring 20 may be moulded integrally from a piece of steel board.

The first end of the leaf spring 20 is connected with the tail end of the handle 30, and the second end of the leaf spring 20 is a free end. The front end of the handle 30 is further configured with a pin 40 in cooperation with the leaf spring 20. The blade 10 closes up through rotation around a pin shaft 15 anti-clockwise. The pin 40 biases the leaf spring 20 such that the leaf spring 20 stores energy. By pushing the dial button 52 in the direction shown by the arrow in FIG. 6, the lockup switch 50 can be unlocked. Meanwhile, the free end of the leaf spring 20 applies force to the pin 40 to eject the blade 10 clockwise.

In fact, the pin 40 has an ordinary cylinder structure. As metal is resilient, no matter which direction the force is applied to the leaf spring 20, deformation will occur in any case. Since the leaf spring 20 has a certain length along the extending direction of the handle 30, resilient deformation perpendicular to the normal direction of the side surface of the leaf spring will occur at the free end of the leaf spring 20, namely, resilient deformation will occur vertically along the handle 30 so as to enable energy storage of the leaf spring 20 in cooperation with the pin 40.

With the folding knife of the invention, the leaf spring 20 and the handle 30 are moulded integrally from a piece of steel boar, so the structure is very simple. The structure of a safety lock provided on the blade is very smart and covert. A slight push on the dial button 52 is enough to unlock the safety lock. The operation is very convenient, practical and reliable.

The above are only the preferred embodiments of the invention and not intended to limit the invention. For skilled in the art, any alterations and variations may be made to the present invention. Any modifications, equivalent replacements, improvements and the like within the spirit and principle of the invention shall fall within the scope of protection of the invention.

The invention claimed is:

1. A folding knife, comprising:

a blade (10), whose upper part is configured with a lockup switch mounting hole (11);

a handle (30), whose lower part is configured with a stopping slot (31);

a lockup switch (50) provided in the lockup switch mounting hole (11) and having a lockup part (51) located on a first side of the blade (10), wherein the lockup part (51) has a lockup position at which the lockup part is clamped in the stopping slot (31) when the blade (10) is pivoted to be within said handle (30), and an unlock position at which the lockup part is released from the stopping slot (31) when at least a portion of the blade (10) is out of the handle and extended away from the handle (30);

wherein the lockup switch mounting hole (11) is a long hole parallel with an extending direction of the blade (10);

wherein the lockup switch (50) further comprises:

a spring (53) provided in the long hole and in an extending direction of the long hole; and a stopper (55), located between one end of the spring (53) close to a tip of the blade (10) and an inner wall of one corresponding end of the long hole, with the lockup part (51) connected with the stopper (55); and a dial button (52) located on a second side of the blade (10) and connected with the stopper (55), wherein to unlock the blade (10) and the handle (30), a movement direction of the lockup part (51) is away from a tip the blade (10) and opposite to a direction of a reset force of the spring (53).

2. The folding knife according to claim 1, wherein an outer surface of the dial button (52) is configured with anti-skid corrugations.

3. The folding knife according to claim 1, wherein one end of the stopper (55) connected with the spring (53) is configured with a groove, and one end of the spring (53) close to the blade (10) is located in the groove.

4. The folding knife according to claim 3, wherein the stopper (55) further comprises a cylinder-shaped mounting hole (55*a*), and the lockup part (51) is connected with the stopper (55) through a cylinder-shaped splicing part (57) in interference fit with the cylinder-shaped mounting hole (55*a*).

5. The folding knife according to claim 4, wherein the lockup switch (50) further comprises a locking block (54) matching with the lockup switch mounting hole (11) in shape, and the lockup part (51) and the cylinder-shaped splicing part (57) are located on two sides of the locking block (54) respectively.

6. The folding knife according to claim 5, wherein an inner wall of the lockup switch mounting hole (11) is formed with two stepped surfaces, the spring (53) and the stopper (55) are corresponding with the first stepped surface, and the locking block (54) is corresponding with the second stepped surface.

7. The folding knife according to claim 1, further comprising a leaf spring (20), with the leaf spring (20) and the handle (30) being integrated.

8. The folding knife according to claim 7, wherein a first end of the leaf spring (20) is connected with a tail end of the handle (30), a second end of the leaf spring (20) is a free end, and the blade (10) is further configured with a pin (40) in cooperation with the leaf spring (20).

9. The folding knife according to claim 1, wherein the handle further has a knife slot for receiving the blade when the blade (10) is pivoted to be within said handle (30), and wherein the stopping slot is laterally facing and opens into the knife slot.

10. The folding knife according to claim 1, wherein the lockup part is located only on the first side of the blade.

11. The folding knife according to claim 1, wherein the spring biases the lockup part toward a tip of the blade.

* * * * *